United States Patent [19]

Micko

[11] Patent Number: 5,036,639

[45] Date of Patent: Aug. 6, 1991

[54] PLATE FOR FALSE FLOORS

[75] Inventor: Manfred Micko, Eching, Fed. Rep. of Germany

[73] Assignee: Rheinhold & Mahla GmbH, Munich, Fed. Rep. of Germany

[21] Appl. No.: 520,271

[22] Filed: May 7, 1990

[30] Foreign Application Priority Data

May 5, 1989 [DE] Fed. Rep. of Germany ..... 3914907

[51] Int. Cl.[5] ..... E04B 1/00; E04F 15/06

[52] U.S. Cl. ..... 52/507; 52/180; 52/303; 52/663; 52/669

[58] Field of Search ..... 52/507, 663, 669, 303, 52/180

[56] References Cited

U.S. PATENT DOCUMENTS 184,817 11/1876 Anderson ..... 52/180
3,369,337 2/1968 Butler ..... 52/669
4,198,795 4/1980 Barnidge ..... 52/180
4,562,678 1/1986 Carroll et al. ..... 52/303

FOREIGN PATENT DOCUMENTS 1023124 12/1977 Canada ..... 52/669
1197344 7/1965 Fed. Rep. of Germany ..... 52/669

*Primary Examiner*—Richard E. Chilcot, Jr.
*Assistant Examiner*—Deborah McGann Ripley
*Attorney, Agent, or Firm*—Herbert L. Lerner; Laurence A. Greenberg

[57] ABSTRACT

A load-bearing plate for false floors includes a plurality of mutually parallel and spaced apart approximately C-shaped metal profiles. The profiles have open bottoms and having tops with parallel, transversely extending recesses formed therein. Bolts are transversely inserted through the profiles for bracing the profiles to one another.

6 Claims, 1 Drawing Sheet

PLATE FOR FALSE FLOORS

The invention relates to a plate for false floors, in which square load-bearing floor plates are laid on vertical adjustable supports that have support plates on the upper end.

Such false floors are known in a great variety. They are generally used as installation floors, in which wiring cables are laid underneath the supported floor plates. A carpet is usually laid on top of plates that form an unbroken surface. However, if the floor must be ventilated from below and/or if vehicles must operate in heavily loaded areas of the floors, then it is conventional to construct the plates that are to be mounted on the supports as gratings. However, such gratings have the disadvantage of having a relatively large mesh spacing and moreover can only carry loads up to a certain order of magnitude.

It is accordingly an object of the invention to provide a plate for false floors, which overcomes the hereinafore-mentioned disadvantages of the heretofore-known devices of this general type, which firstly can be freely ventilated from below and which secondly can bear extremely high loads of at least 500 kg per plate, with the plate size generally being 600×600 mm.

With the foregoing and other objects in view there is provided, in accordance with the invention, a substantially rectangular or square load-bearing plate for false floors, laid on vertical adjustable supports that have support plates on the upper end, comprising a plurality of mutually parallel and spaced apart approximately C-shaped metal profiles, the profiles having open bottoms and having tops with parallel, transversely extending recesses formed therein, and bolts transversely inserted through the profiles for bracing the profiles to one another.

The approximately C-shaped construction of the profiles gives them a very high load-bearing capacity. Since the profiles are also disposed alongside one another in a spaced-apart fashion and are partly cut away on the top and bottom, the result is an open flow-through area that amounts to at least 60% of the total plate area, given a suitable construction.

In accordance with another feature of the invention, each of the profiles has long sides and a given width and is spaced from another of the profiles by a given spacing, and including sleeve-like spacers disposed on the bolts, each of the spacers having an outside diameter and having a length equal to the given width plus the given spacing, each of the long sides having a respective mutually aligned bore formed therein, one of the bores having the same diameter as the bolts and the other of the bores having the same diameter as the outside diameter of the spacers. This is done in order to provide for rigidly spacing apart the individual profiles.

In accordance with a further feature of the invention, the long sides have inner and outer surfaces, the spacers have one end surface abutting the inner surface of one of the long sides of one of the profiles, a portion penetrating the other of the long sides of the one profile, and another end surface resting on the outer surface of one of the long sides of an adjoining profile.

Thus the spacers are disposed in such a way that their ends always abut one another on either side of a long side of a profile, preventing the profiles themselves from being pressed together and thereby deformed.

In accordance with an added feature of the invention, the profiles have a given wall thickness, and the profiles include outer profiles and other profiles, and including another spacer disposed at any outer profile having an internal thread and a length equal to the given width minus the given wall thickness, the bolts having free ends penetrating the other profiles and being screwed into the internal thread. This provides for the final locking of the adjoining profiles.

In accordance with a concomitant feature of the invention, there is provided a locking bolt screwed into the free end of the other spacer at the outer profile.

Other features which are considered as characteristic for the invention are set forth in the appended claims.

Although the invention is illustrated and described herein as embodied in plate for false floors, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of specific embodiments when read in connection with the accompanying drawings.

Figure 1:
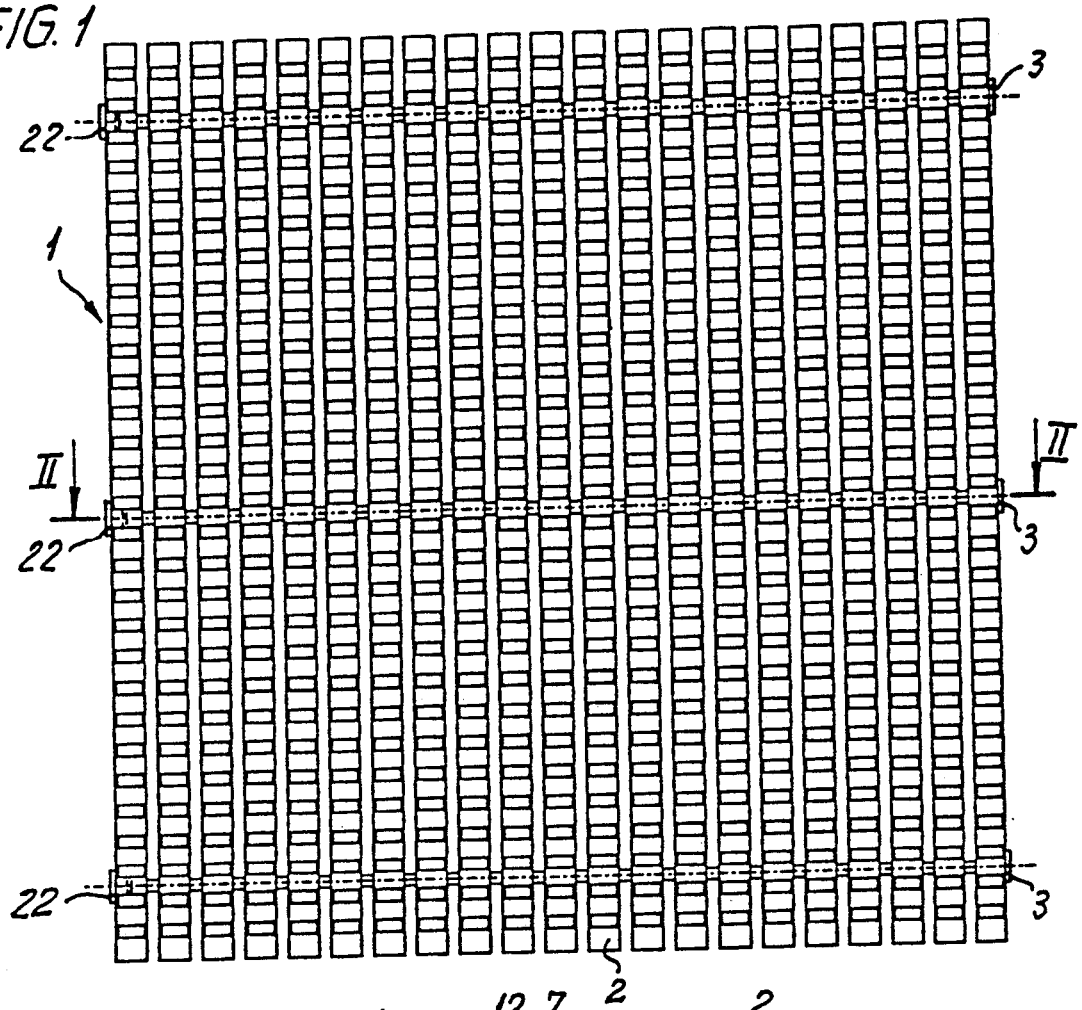
FIG. 1 is a diagrammatic plan view of a complete plate.

Referring now to the figures of the drawings in detail and first, particularly, to FIG. 1 thereof, there is seen one of several plates 1, each of which are formed, for instance, of twenty-one profiles 2 that extend parallel to and spaced apart from one another, and are joined together and braced by three bolts 3 passing transversely through them. The square load-bearing floor plates are laid on vertical adjustable supports that have support plates on the upper end.

Figure 2:
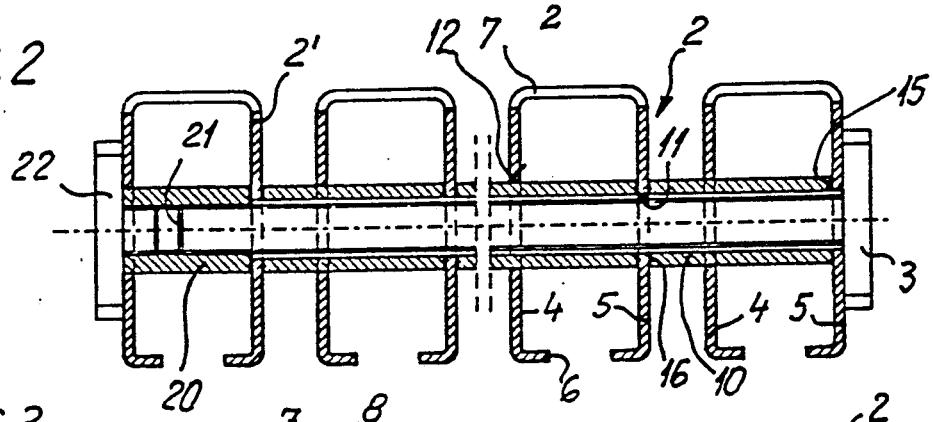
FIG. 2 is a shortened cross-sectional view of the plate, on an enlarged scale, taken along the lines II—II of FIG. 1, in the direction of the arrows.
Figure 3:
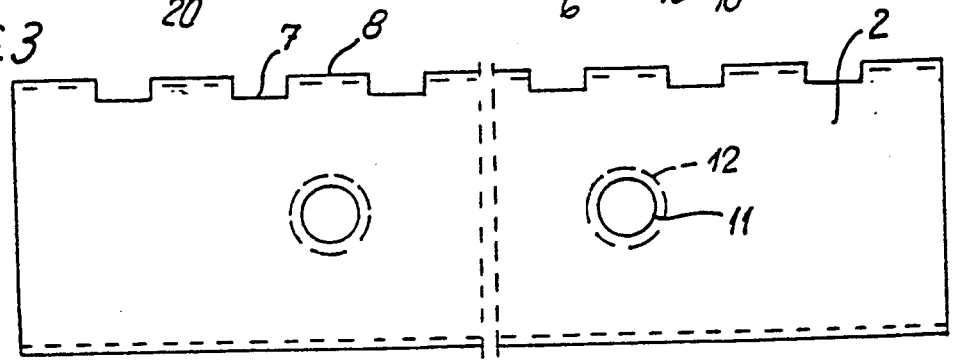
FIG. 3 a side-elevational view of an individual profile.

The construction of such a profile can be seen from FIGS. 2 and 3, wherein each profile 2 has an approximately C-shaped cross section having long sides 4 and 5 with parallel lateral surfaces and being open on the bottom in the form of a wide gap 6. The top of the profile is an essentially unbroken surface, provided with transversely extending, mutually parallel recesses 7, with unbroken zones 8 provided therebetween. The total area of the recesses or cut-away zones 7 of each profile 2 is approximately equivalent to the area of the open gap 6 on the bottom, thus enabling a uniformly free passage of air through the various profiles 2.

The spacing and bracing of the various profiles 2 with respect to one another is effected by sleeve-like spacers 10, which are disposed as follows:

Each profile 2 has bores 11 and 12 which are aligned with one another in the long sides 4 and 5. The bore 11 in the long side 5 has a diameter that is slightly greater than the diameter of the bolt 3. In contrast, the bore 12 in the other long side 4 has a larger diameter, which is equivalent to the outside diameter of the spacer 10. The sleeve-like spacers 10 have a length that is equal to the width of one profile 2, minus a wall thickness of a long side 5, plus the spacing between two profiles 2. The spacers 10 which are slipped onto the bolts 3 are disposed in such a way that one end surface 15 thereof rests on the inner surface of one long side 5, they have a portion penetrating the other long side 4, and the other end surface 16 thereof abuts the outer surface of the long side 5 of the following or adjoining profile 2.

The advantage of this kind of construction and disposition of the spacers 10 is that it ensures that the spacers 10 are not only located in the open zone between two adjacent profiles 2, where they could press the profiles together upon lateral pressure. Instead, they also abut the inside and outside of a lateral surface of a long side 5 of a profile 2 and thus rest rigidly against one another.

The bracing of the profiles 2 against one another over the entire width of one plate 1 is carried out due to the fact that another, outer sleeve-like spacer 20 in the outer left profile 2' is only as long as one profile width minus a wall thickness and is provided with an internal thread. The free end 21 of the bolt shaft of the bolt 3 penetrating the other profiles 2 is likewise provided with a thread and is screwed into the outer sleeve-like spacer 20 until firm bracing between the free end 21 and the outer profile 2' is attained.

The free outer opening of the spacer 20 can then be closed with a further locking screw bolt 22.

With this kind of construction, a plate for a false floor is accordingly attained that can withstand extremely high loads and has a large open cross section for the passage of air therethrough. Furthermore, such a plate can be assembled quickly and easily using only a few different individual parts, which provides great flexibility.

I claim:

1. Load-bearing plate for false floors, comprising a plurality of mutually parallel and spaced apart approximately C-shaped metal profiles, said profiles having open bottoms and having tops with parallel, transversely extending recesses formed therein, and bolts transversely inserted through said profiles for bracing said profiles to one another, wherein each of said profiles has long sides and a given width and is spaced from another of said profiles by a given spacing between said profiles, and including sleeve-like spacers disposed on said bolts, each of said spacers having an outside diameter and having a length equal to said given width plus said given spacing, each of said long sides having a respective mutually aligned bore formed therein, one of said bores having the same diameter as said bolts and the other of said bores having the same diameter as the outside diameter of said spacers.

2. Plate according to claim 1, wherien said long sides have inner and outer surfaces, said spacers have one end surface abutting said inner surface of one of said long sides of one of said profiles, a portion penetrating the other of said long sides of said oneprofile, and another end surface resting on said outer surface of one of said long sides of an adjoining profile.

3. Plate according to claim 2, wherein said profiles have a given wall thickness, and said profiles include an outer profile and other profiles, and including another spacer disposed at said outer profile having an internal thread and a length equal to said given width minus said given wall thickness, said bolts having free ends penetrating said other profiles and being screwed into said internal thread.

4. Plate according to claim 3, including a locking bolt screwed into said other spacer at said outer profile.

5. Plate according to claim 1, wherein said profiles are disposed in a substantially rectangular configuration.

6. Plate according to claim 1, wherein said profiles are disposed in a substantially square configuration.

* * * * *